United States Patent [19]

Guetle, Jr. et al.

[11] Patent Number: 4,882,877

[45] Date of Patent: Nov. 28, 1989

[54] RESIDENTIAL DOOR MANUFACTURE AND INSTALLATION

[75] Inventors: Norbert J. Guetle, Jr., Cincinnati; Daniel J. Spencer, Hamilton, both of Ohio

[73] Assignee: Pease Industries, Inc., Fairfield, Ohio

[21] Appl. No.: 300,442

[22] Filed: Jan. 23, 1989

[51] Int. Cl.[4] ..... E06B 3/00

[52] U.S. Cl. ..... 49/506; 49/501; 49/507; 52/456; 52/745

[58] Field of Search ..... 49/380, 501, 507, 506; 206/325, 321; 52/455, 456, 741, 745

[56] References Cited

U.S. PATENT DOCUMENTS

| | | | |
|---|---|---|---|
| 432,504 | 7/1890 | Amsden | 52/455 |
| 1,285,269 | 11/1918 | Lunken . | |
| 2,489,029 | 11/1949 | Guerrant . | |
| 2,706,837 | 4/1955 | Jackson . | |
| 2,728,956 | 1/1956 | Jackson | 49/380 |
| 2,795,327 | 6/1957 | Clay . | |
| 3,299,596 | 1/1967 | Neal et al. | 49/501 X |
| 3,512,304 | 5/1970 | Meuret | 49/501 |
| 3,760,543 | 9/1973 | McAllister | 52/455 X |
| 4,387,545 | 6/1983 | Kern | 52/455 |
| 4,583,639 | 4/1986 | Fedick et al. . | |
| 4,716,700 | 1/1988 | Hagemeyer | 52/456 |
| 4,718,195 | 1/1988 | Ortega | 49/380 |
| 4,825,615 | 5/1989 | Turner | 52/455 |

*Primary Examiner*—Philip C. Kannan

*Attorney, Agent, or Firm*—Biebel, French & Nauman

[57] ABSTRACT

A wooden door for installation as the entry door of a new or remodeled residence is completely factory prefinished by fabricating all wooden parts to accurate dimensions and staining all these parts, including cutouts in the door blank for a lock assembly and other hardware, before assembly. After preliminary staining and assembly, all final finishing operations are performed on the door, and it is packaged in a protective package, along with its hardware, and shipped as a separate item to the resident site. The frame in which the prefinished door is to be mounted in the completed residence is also factory assembled, a temporary door of expendable quality is installed therein, and the frame and temporary door are shipped to the site independently of the final door for installation as soon as the residence has been completed to the point where installation of the door frame is in order. Then after construction or remodeling has been completed except for the entry door, the temporary door is replaced by the prefinished door. For doorways which include sidelights, the sidelight assemblies are similarly completely factory prefinished and supplied in a protective package to the site, and while the door frame is in place during construction or remodeling, the openings in the door frame for the sidelight assemblies are temporarily filled by hardboard panels which are replaced by the finished sidelight assemblies when the final door is installed.

18 Claims, 3 Drawing Sheets

14
3
16
11
20
20
13
10
22
20
20
3
12
16
17
20
20
16
15

RESIDENTIAL DOOR MANUFACTURE AND INSTALLATION

Background of the Invention

The development of the present invention has resulted in part from recognition of the fact that an exterior door for a newly constructed residence, particularly a door of all wood construction, is often subject to damage by contact with foreign objects if it is installed before construction of the residence has otherwise been essentially completed. Thus it often happens that an attempt is made to close the door while some foreign object is extending through the doorway, such for example as a hose, a rope, a piece of building material or an electric cable such as an extension cable. Also, building materials, appliances and other objects which are carried through the doorway in the course of construction can strike and mar the door unless they are handled with adequate care, and painting in the vicinity of the doorway can also damage a new door.

It has been suggested in the past, by the assignee of this application, that damage of this type to the entry door for a residence under construction could be avoided by delaying installation of the door until the residence had been essentially completed. However, it is desirable that a residence under construction be provided with means for closing it against intruders, especially during the late stages of construction. It was therefore also suggested that another door, of too low quality to be used as the final door, e.g. a door in inventory which had been damaged, be installed as a temporary closure during completion of the residence, and then be replaced by the final door as part of the finishing operation on the residence.

There were at least two problems with this proposed procedure. One was that it presumed the availability of a temporary door of the requisite dimensions and sufficiently low cost to be expendable. Also, it made no provision for protection of the final door prior to its installation, which could be a serious problem if the builder followed the practice of ordering the final door and storing at the job site prior to its installation.

Summary of the Invention

The present invention is directed to providing a practical answer to the need summarized in the preceding section. According to the invention, the final door of all wood construction for a residence under construction is supplied to and stored at the site in its own protective package, and the door frame in which it is to be installed is shipped to the site as a separate item along with a temporary door of the same height and width as the final door but of sufficiently less equality to be expendable when the residence is completed.

Preferably this temporary door is installed in the door frame before shipment, and it is retained therein until the residence is essentially completed, including whatever painting or other finishing is required for the door frame. Thus the final door is installed only after completion of all operations incident to building the residence which might damage that door if it had already been installed.

An associated feature of the invention is that it is especially applicable to residence wood doors of high quality materials and construction, as well particularly as finishing. More specifically, the invention proposes that door be provided at the site of the residence as a blank of the proper dimensions in which all cut-outs for hardware such as the lock mechanism and hinges are made prior to finishing, i.e. painting or staining, so that the interiors of these cut-outs will be sufficiently finished to assure that no unfinished wood areas can be seen, even in areas which are exposed by uneven shrinkage of component parts of the door. Thus all that remains for final installation of the door will be the attachment of the hardware, which may be done at the place of manufacture or on site, and the final hanging of the door in its frame.

The high quality residence doors with which the invention particularly concerned will virtually invariably include decorative panels inserted in openings through the door blank, including both decorative glass panels and also wood panels which are used to vary the outside appearance of the finished door. It is a particular feature of the invention that in the initial construction of the door blank, all of its separate wood components, i.e. wood panels and the moldings by which panels are mounted in the blank, are finished before they are assembled to complete the door blank, thereby assuring that whatever differential shrinkage may occur in the door during use, there will never be an occasion when unfinished wood is exposed and visible.

While as noted above, the invention was developed initially with the objective of overcoming problems primarily related to new construction, it is equally applicable to remodeled residences, where similar problems arise while the construction related to remodeling is in progress. In addition, while the door is the primary constituent of the entry to a residence, many doorways also include side lights on either side of the door itself, and the practice of the invention extends to the production, finishing and protection of sidelights in the same manner as doors.

These and other objects and advantages of the invention will be apparent from or pointed out in connection with the description of the preferred embodiment which follows.

Description of the Preferred Embodiment

Figure 1:
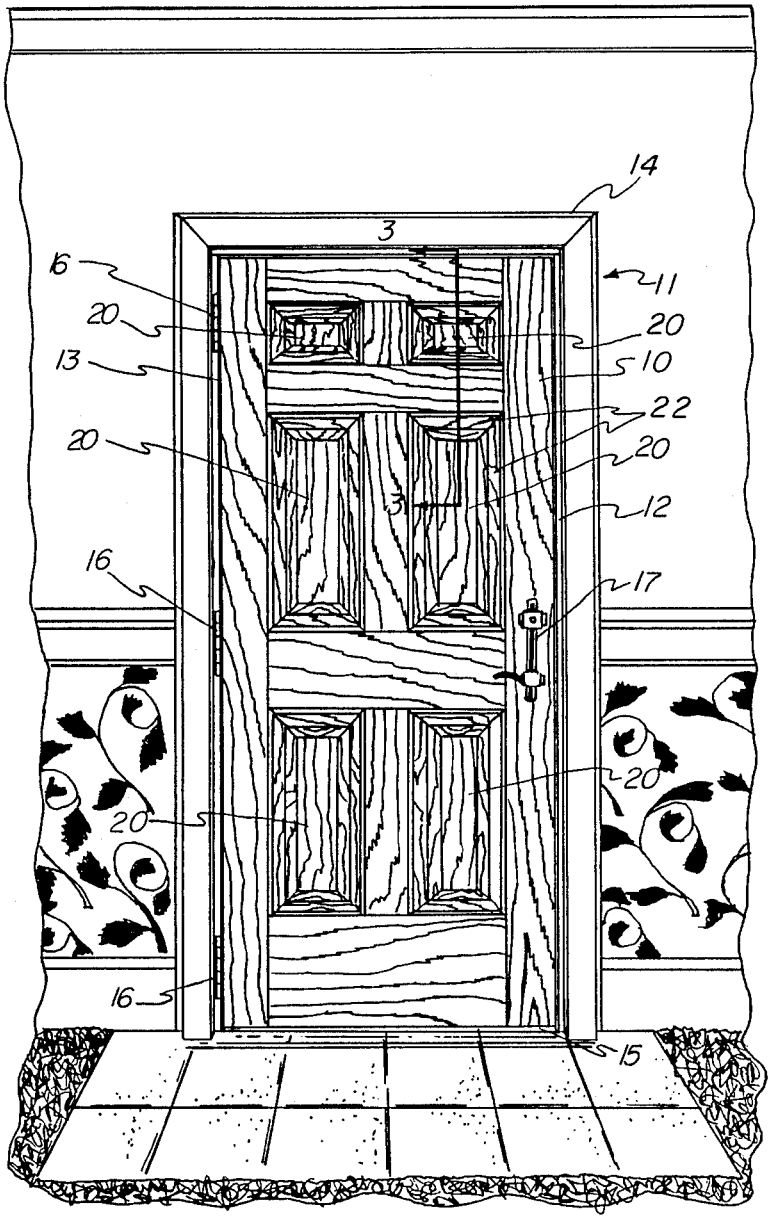
FIG. 1 is a partial view from the inside of the front doorway of a residence provided with a door in accordance wi invention.

In FIG. 1, the door 10 is shown as an exterior door of a residence which is hinged for opening movement inwardly of a conventional door frame 11 comprising a lock side jamb 12, a hinge side jamb 13, a top jamb 14 and a sill 15. The door is shown from the inside of the residence in order to include the hinges 16 by which it is mounted on the jamb 13. It is also shown as provided with a conventional handle and latch assembly 17.

As previously discussed, the advantages of the invention are most fully appreciated in conjunction with doors 10 of high quality wood, except for metal hardware, and except also for a panel or panels of glass which may be included in the door. The door 10 in FIG. 1 does not include any glass panel, but it does incorporate six rectangular panels 20 of wood, each of which is set in a correspondingly sized opening 21 through the body of the door and are held therein by complementary pairs of moldings 22, one on each side of the door. The moldings 22 may be secured to the body of the door by suitable adhesive to eliminate the possibility of disfiguring of the outer surface of the door such as could result from nails or other metallic fastening means, but if such nail means are used, they are hidden in the course of final finishing of the door.

Figure 3:
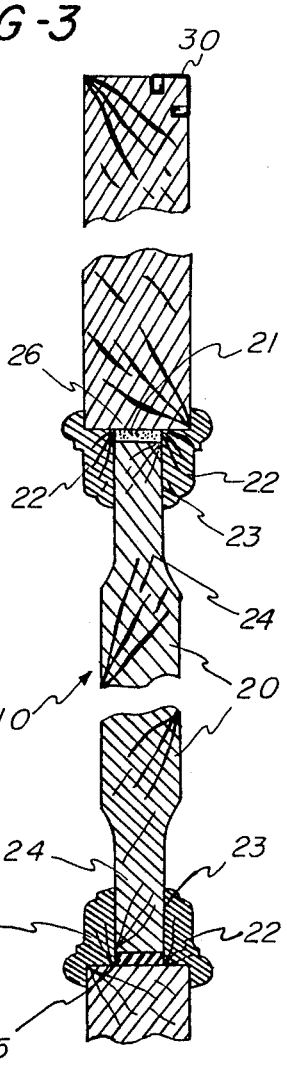
FIG. 3 is a fragmentary section on the line 3—3 of FIG. 1 and on a larger scale.

As shown in FIG. 3, the moldings 22 are proportioned to define between them a slot 23 which extends around the inner periphery of the associated opening 21 that receives the marginal portion 24 of reduced thickness around the periphery of the associated panel 20. The overall dimensions of each panel 20 are controlled to provide it with substantial clearance in its opening 21, e.g. a total of in the range of ¼ to ⅜ inch. Also, the thickness of the panel portion 24 and the width of slot 23 are so controlled that the panel portion 24 is held sufficiently firmly to prevent the panel from moving except as may be necessary to compensate for differential expansion and construction of the panel and molding, as further discussed hereinafter. It is desirable to center each panel 20 as consistently as possible in its receiving opening 21 while allowing for relative expansion and contraction of the panels with respect to the door. For this purpose, the portion of each slot 23 which supports the bottom edge of a panel 20 is lined with a gasket 25 comprising a strip of relatively hard elastomeric material, e.g. 60 Durometer rubber, which will support the weight of the panel and thereby keep the panel centered in its opening 21 in the door.

The portions of each slot 23 around the sides and top of each panel are also similarly lined with a gasket 26, but each gasket 26 should be a strip of relatively compressible material, such as open cell of polyurethane foam, which will maintain sealing engagement with the top and side edges of the associated panel 20 as the panel expands or contracts with respect to the body of the door. With this combination of gaskets of different materials, each panel 20 will remain substantially centered in its receiving opening 21 over all of its normal shrinkage and expansion range, and the gaskets will also maintain a continuous sealing action against the passage of air around the edge of a panel by way of its retaining slot 23.

Figure 2:
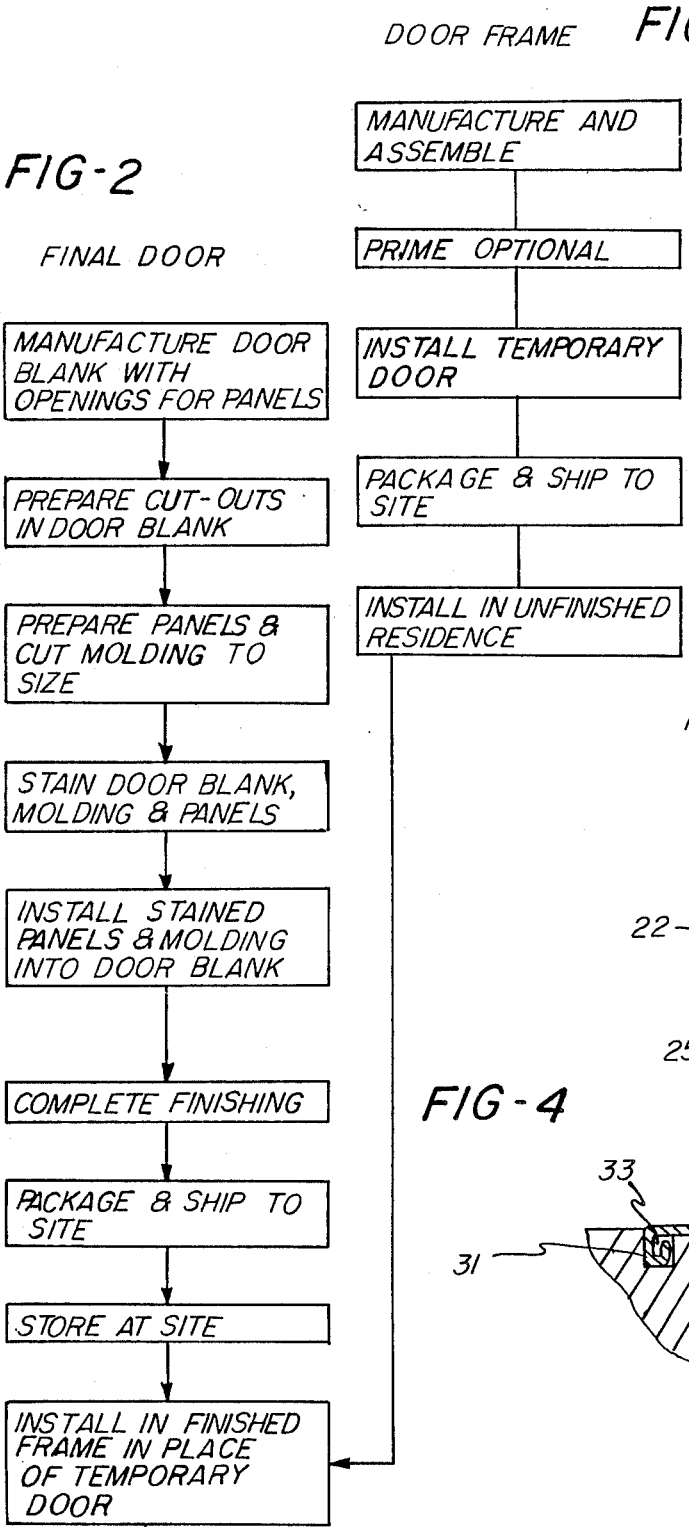
FIG. 2 is a flow diagram illustrating the method of producing and installing the residential door to the doorway as shown in FIG. 1.

The sequence in which the door 10 and its related components are manufactured and installed is a key to the success of the invention in practice. As illustrated in FIG. 2, the door 10 is first constructed as a door blank which accurately conforms to the desired final dimensions but is referred to as a "blank" because at this stage of its manufacture, it is essentially a door framework having all necessary openings 21 therethrough between its component stiles and rails for the subsequent insertion of wood or glass panels.

Before the surface of this door blank is finished, all necessary cut-outs are made therein for receiving metal hardware, e.g. an edge recess and through holes for the lock assembly 17, the screw holes for each of the hinges 16, and whatever mortises for the hinges may be needed. Also, all necessary wood panels 20 are fabricated to size, and all necessary moldings 22 for mounting those panels are accurately miter cut to size.

The invention has been developed in order to make maximum use of the grain patterns and other natural features of woods of high stability, strength and beauty, such as oak, teak and mahogany. In accordance with conventional practice, such woods may be used in the construction of a door blank as surface layers or veneers adhered to an inner framework of less expensive wood, but with some woods, e.g. mahogony, the door may be solid rather than veneered. In any case the entire outer surface of the finished door, including the panels 20 and moldings 22, will be of the same variety of high quality appearance wood.

Such woods should be finished by staining, rather than painting, so that their grain patterns will show clearly, and it is at this stage in the practice of the invention that the door blank and its individual wood constituents are preliminarily finished by application of the necessary coats of the appropriate stain. The staining treatment should include all surfaces of the door blank and the other wood parts, including particularly the marginal edges of the panels 20 which are enclosed by the moldings 22, and the moldings themselves. Care should be taken to insure that the stain penetrates all cut-outs before any metal parts are mounted therein.

After all wooden parts of the door have been stained, the panels and moldings are installed in or on the door blank, and final finishing of all exposed surfaces of the door is carried out. Necessarily, final finishing, such as waxing and polishing, does not extend to the stained areas of the panels 20 which are normally hidden by moldings 22. However, all areas of the panels that are exposed will receive the final finishing treatment, and the overall stained color of the wooden parts of the door will still be the same as on the normally concealed areas. Therefore any of those areas which may be exposed as a result of differential shrinkage of adjacent parts will blend with the adjacent areas and thus be effectively not noticeable.

Figure 4:
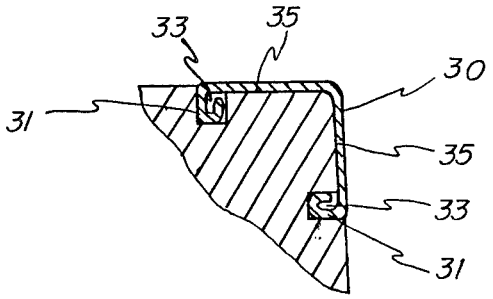
FIG. 4 is an enlarged fragment of FIG. 3.

Preferably the hinges and lock assembly are not installed until just prior to mounting the finished door in its frame, primarily because if the handles were installed, a much thicker shipping carton would be needed. However, doors processed in accordance with the invention are preferably provided at their place of manufacture with a narrow, right angled trim strip 30 of metal along the outer corners of their sides and top, as illustrated in FIGS. 3 and 4 The purposes of these strips 30 are both to protect and to finish these parts of the door, and also to provide effective cooperation with magnetic weather stripping, as disclosed in the co-owned pending application of Norbert J. Guetle, Jr., Ser. No. 143,543, filed Jan. 13, 1988, the disclosure of which is incorporated herein by reference.

Each of the trim strips 30 includes a flange 31 extending inwardly of its L-shape along each of its outer edges, and these flanges are forced into a pair of grooves 33 in the outer face and edge of the door. Also, the outer face of the door and the surface of its edge portion between each slot 33 and the corner of the door are relieved by an amount equal to the thickness of the trim strip 30, as indicated at 35 in FIG. 4, so that the outer surface of the trim strip will be flush with the adjacent surfaces if the door face and edge. The grooves 33, and the relieved areas 35 therebetween, should be cut prior to finishing of the door so that they also will receive the staining treatment along with the surfaces of the door.

When the door blank has been completed to the extent that it has been fully finished and the trim strips 30 have been mounted thereon, it is provided with its own protective package, which may include a wrapping of protective plastic sheeting, but which in any case will include an individual carton of heavy corrugated board or the like. Preferably, the hinges and lock assembly are packaged in the same carton, so that after shipment of the carton to the building site, the door and its hardware can be stored in the carton for maximum protection until the residence has been essentially completed except for installation of its front door.

Maximum use of the invention requires that the door frame be manufactured contemporaneously with the door blank in order to be certain that they will be of the proper matching sizes. The frame need not be finished at the manufacturing site, but if it is ultimately to be finished by painting it is desirable that a prime coat of paint be applied at the time of its assembly at the manufacturing plant to any areas that are to be painted. If it is ultimately to be finished by staining, however, it may be packaged and shipped in bare wood condition.

An important element in the practice of the invention is the provision of a temporary door for use after the residence has been built to a sufficient extent to be ready for installation of the door frame. Preferable this temporary door should be of the same height and width as the door 10, and it should be of sufficiently lower quality than the door 10 to be expendable, such as a simple wood frame covered with panels of masonite or other hardboard. Preferably the temporary door should be mounted by inexpensive hinges in the frame for the finished door at the place of its manufacture, and the frame with the temporary door mounted therein is shipped to the site in a package separate from the package containing the finished door 10.

This procedure in accordance with the invention makes it possible to keep the final door 10, and its hardware, in their protective package until the residence has otherwise been completed, including particularly the finishing of the door frame by staining or final painting. This is an important advantage provided by the invention, in that all painting, staining or other finishing operations in the vicinity of the doorway, including those on the door frame itself, can be carried out without concern for damage to the door because the temporary door is expendable. Then when the residence has been completed except for installation of its entry door, the temporary door and its hinges are removed from the frame, and the prefinished final door is installed by means of its own hardware.

Figure 5:
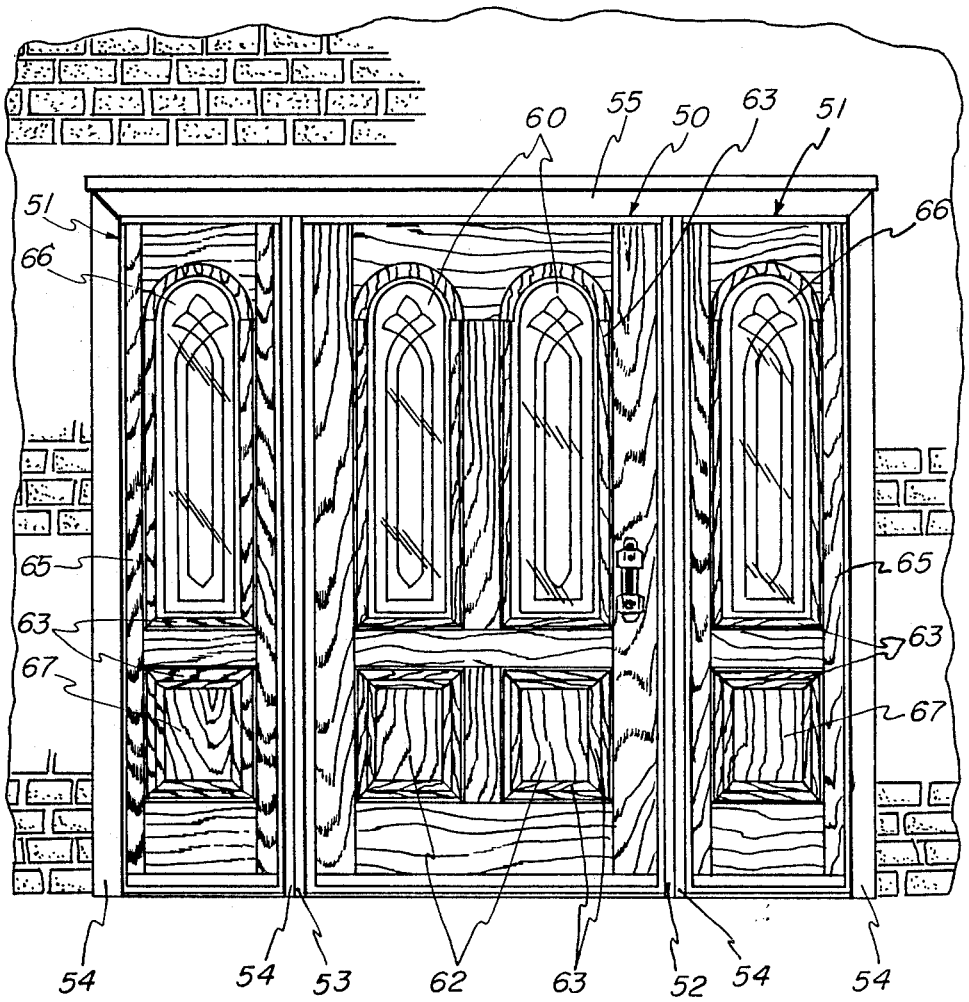
FIG. 5 is a view similar to FIG. 1 illustrating the outside of provided with an entry including a door and a pair of side lights in accordance with the invention.

FIG. 5 illustrates the exterior of a residential doorway which includes both a door 50 and a sidelight assembly 51 on either side of the door, with the door and sidelights all mounted in a common frame. This frame accordingly includes a lock side jamb 52 and a hinge side jamb 53 framing the door, additional jambs 54 framing each of the sidelight assemblies, and a top jamb 55 extending the full width of the compound frame above the door and both sidelight assemblies 51.

The door 50 is of essentially the same construction already described in connection with door 10, except that the door 50 is provided with a pair of glass sidelight panels 60 as well as a pair of essentially square wood panels 62. Each of these panels is mounted in an appropriate opening through the door by means of moldings 63 of essentially the same cross sectional configuration as the moldings 22 and in essentially the same manner described in connection with FIG. 3.

Each of the sidelight assemblies 51 is also of essentially the same basic construction as the door 50, in that each includes a blank 65 of wood in which a sidelight panel 66 and a wood panel 67 are mounted by means of moldings 63. The sidelight assemblies are manufactured and finished in the same way as already described in connection with the door 10, namely by initially manufacturing the blank 65 and the individual panels 66 and 67 together with the necessary pieces of molding 52, staining all of these wood parts before they are assembled, and then subjecting the completed assembly to final finishing treatments.

For each installation of a doorway like the one shown in FIG. 5, the complete frame 52–55 is manufactured and preliminarily finished as described in connection with FIGS. 1 and 2, and then finally finished after the panels 66 and 67 have been installed in the blank 65. Prior to shipment to the site, this frame assembly is provided with a temporary door and also with temporary panels, e.g. of hard board, mounted in place of the sidelight assemblies, with the latter are separately packaged and shipped for protective storage on site until the construction or remodeling of the residence is essentially completed except for installation of the door. Only then are the temporary door and temporary side panels removed and replaced by the finished door and sidelight assemblies.

While the methods herein described, and the products produced thereby, constitute preferred embodiments of the invention, it is to be understood that the invention is not limited to these precise methods and products, and that changes may be made therein without departing from the scope of the invention which is defined in the appended claims.

What is claimed is:

1. The method of providing a completely finished residential door of wood at the site of the residence where it is to be installed in a door frame of predetermined dimensions and of protecting said door prior to installation thereof, comprising the steps of:

(a) constructing a wood door blank of predetermined dimensions to fit said door frame, (b) providing in said door blank the cut-outs needed for the installation of hardware, (c) finishing said door blank including the interiors of all such cut-outs, (d) enclosing the resulting finished door in a protective package, and (e) shipping said package to and storing said door in said package at said site while said residence is being completed.

2. The method defined in claim 1 further comprising the steps of supplying said door frame to said site separately from said door, also supplying to said sire a second door of the same dimensions as said finished door but of lesser quality, installing said door frame in the unfinished residence, hingedly mounting said second door in said frame for use as a closure for said residence prior to completion thereof, and after said residence is essentially completed, removing said second door from said frame and hingedly mounting said finished door in said frame.

3. The method defined in claim 2 wherein said second door is mounted in said frame prior to supplying said frame to said site.

4. The method defined in claim 1 comprising the further steps of providing said door blank with openings for receiving therein decorative panels of predetermined dimensions, finishing said panels separately from said door blank and together with any wood moldings needed for mounting said panels in said door blank, and installing said finished panels in said finished door blank prior to said packaging step.

5. The method of constructing and installing a residential doorway in a newly constructed or remodeled residence which comprises the steps of:

(a) constructing a wood door blank of predetermined dimensions,
(b) providing in said door blank the cut-outs needed for the installation of hardware,
(c) finishing said door blank including the interiors of all such cut-outs,
(d) constructing a wooden door frame of the proper dimensions to receive said door blank therein,
(e) constructing a second door of the same dimensions as said finished door but of lesser quality,
(f) enclosing said finished door in a protective package,
(g) shipping said package and said door frame and second door to the site of said residence while said residence is under construction or remodeling,
(h) installing said door frame and second door in said residence,
(i) substantially completing the construction or remodeling of said residence including the finishing of said door frame, and
(j) thereafter removing said second door from said frame and hingedly mounting said finished door in said frame.

6. The method defined in claim 5 wherein said second door is mounted in said door frame prior to shipment thereof to said site.

7. The method defined in claim 5 wherein said door blank constructing and finishing steps comprise the steps of fabricating a door blank containing through openings of predetermined sizes and in predetermined locations, fabricating wooden panels sized to be received in said openings, preparing strips of wood molding sized for mounting in opposed pairs on said door blank in enclosing relation with marginal portions of said openings and said panels, applying stain to said door blank and to the individual said panels and strips of molding, then mounting said stained panels in said openings in said door blank by securing said molding strips on both sides of said door blank in enclosing relation with said marginal portions of said panels, and then effecting final finishing of all exposed wood surfaces of said door.

8. The method defined in claim 5 wherein said doorway includes sidelight assemblies of predetermined dimensions on each side of a door, and further comprising the steps of extending said door frame to provide an opening at each end thereof for receiving a sidelight assembly, constructing a pair of sidelight assemblies of the proper dimensions to be received in said openings in said frame, completely finishing each of said sidelight assemblies including all component wooden parts thereof, installing a separate panel in each of said sidelight openings in said frame, installing said second door in said frame, shipping said frame with said second door and said panels therein to the site of said residence and installing the same in said residence during completion of the construction or remodeling of said residence, enclosing said finished sidelight assemblies in a protective package and shipping the same to said site independently of said finished door and said door frame, and finally replacing said panels in said door frame with said sidelight assemblies.

9. The method of fabricating a completely factory-prefinished residence door of wood which comprises the steps of (a) fabricating a door blank of wood having therethrough at least one opening of predetermined size and location,
(b) fabricating a wooden panel sized to be loosely received in each said opening,
(c) preparing strips of wood molding sized for mounting in opposed pairs on said door blank in surrounding relation with each said opening and enclosing relation with a marginal portion of the periphery of each said panel,
(d) applying stain to all surfaces of said door blank and to said strips of molding and each individual said panel,
(e) mounting each said stained panel in the appropriate said opening in said door blank by securing said pairs of molding strips on both sides of said door blank in enclosing relation with said marginal portion of each said panel, and
(f) then effecting final finishing of all exposed wood surfaces of said door.

10. The method defined in claim 9 which further comprises the step, prior to said stain-applying step, of providing in said door blank the cut-outs needed for the installation of hardware, whereby said stain penetrates all of said cut-outs.

11. A factory-prefinished door for a residence which comprises:

(a) a door blank of wood having therethrough at least one opening of predetermined size and location,
(b) a wooden panel with peripheral clearance in each said opening,
(c) strips of wood molding mounted in pairs on both sides of said door blank in enclosing relation with the periphery of each said opening and a marginal portion of said panel around the periphery thereof,
(d) said door bank having in one side edge thereof a cut-out for receiving a lock assembly of predetermined size, and
(e) all surface areas of said wooden parts, including the surfaces defining said cut-out, being uniformly stained whereby any areas of said marginal portion of each said panel which may be exposed by differential shrinkage of adjacent portions of said door will be of the same color as the normally exposed surfaces of said panel.

12. A factory-prefinished door as defined in claim 11 wherein said pairs of moldings define therebetween a slot wherein the peripheral portion of said panel is received, each said panel is sized to fit so loosely in said opening therefor as to leave a space surrounding the periphery thereof within said slot to provide for differential expansion and contraction of said panel within said slot, and further comprising a strip of relatively hard elastomeric material lining the bottom of each said slot to support the associated said panel in substantially fixed vertical relation with the associated said opening, and a strip of readily compressible gasket material lining the top and sides of each said slot and proportioned to maintain sealing engagement with the periphery of said panel and thereby to prevent the passage of air around the periphery of said panel by way of said slot.

13. A door as defined in claim 12 for inward opening movement on a hinged mounting in a frame provided with magnetic weather stripping along the top and lock side thereof, said door having a face designated as the outside thereof, and further comprising clip-like trim means of magnetic metal extending in enclosing relation with the corner of the lock side and top of said face for magnetically sealing engagement with said weather stripping, each said trim means having in cross section a substantially L-shaped configuration, each of the two sides of said L-shape having a flange along the outer edge thereof extending inwardly of said L-shape, said face and top of said door having grooves therein positioned to receive said flanges on said trim strip and thereby to secure said trim strip on said corners, and the interior of said grooves being stained in matching relation with said surface areas of said door.

14. A door as defined in claim 13 wherein said face and top of said door are relieved between said grooves and said door to a depth equal to the thickness of said trim means, and said relieved areas also being stained in matching relation with said surface areas of said door.

15. A door as defined in claim 11 for inward opening movement on a hinged mounting in a frame provided with magnetic weather stripping along the top and lock side thereof, said door having a face designated as the outside thereof, and further comprising clip-like trim means of magnetic metal extending in enclosing relation with the corner of the lock side and top of said face for magnetically sealing engagement with said weather stripping, each said trim means having in cross section a substantially L-shaped configuration, each of the two sides of said L-shape having a flange along the outer edge thereof extending inwardly of said L-shape, said face and top of said door having grooves therein positioned to receive said flanges on said trim strip and thereby to secure said trim strip on said corners, and the interior of said grooves being stained in matching relation with said surface areas of said door.

16. A door as defined in claim 15 wherein said face and top of said door are relieved between said grooves and said door to a depth equal to the thickness of said trim means, and said relieved areas also are stained in matching relation with said surface areas of said door.

17. The method of providing a residential door at the site of the residence where it is to be installed in a door frame of predetermined dimensions, and of protecting said door prior to installation thereof, comprising the steps of:

(a) constructing a door frame which is of the proper dimension to fit such residence and which defines a door opening of predetermined dimensions, (b) constructing a finished door of the proper dimensions to fit said door frame opening, (c) enclosing said finished door in a protective package independent of said door frame, (d) supplying said door frame and said package to said site separately from each other, (e) also supplying to said site a second door of the same dimensions as said finished door but of lesser quality, (f) installing said door frame in the unfinished residence, (g) hingedly mounting said second door in said frame for use as a closure for said residence prior to completion thereof, (h) storing said finished door in said package while said residence is being completed; and (i) after said residence is essentially completed, removing said second door from said frame and hingedly mounting said finished door in said frame.

18. The method defined in claim 17 wherein said second door is mounted in said frame prior to supplying said frame to said site.

* * * * *

UNITED STATES PATENT AND TRADEMARK OFFICE

CERTIFICATE OF CORRECTION

PATENT NO. : 4,882,877

DATED : November 28, 1989

INVENTOR(S) : Norbert J. Guetle, Jr. and Daniel J. Spencer

It is certified that error appears in the above-identified patent and that said Letters Patent is hereby corrected as shown below:

Column 2, line 46, delete "wi" and insert -- with the --.

Column 2, line 54, after "outside of", add -- a residence --.

Column 4, line 64, "if" should be -- of --.

Column 5, line 27, "Preferable" should be -- Preferably --.

Column 8, line 45, "bank" should be "blank".

Signed and Sealed this

Second Day of July, 1991

*Attest:*

*Attesting Officer*

HARRY F. MANBECK, JR.

*Commissioner of Patents and Trademarks*